US006848601B2

(12) United States Patent
Greer, Jr.

(10) Patent No.: US 6,848,601 B2
(45) Date of Patent: Feb. 1, 2005

(54) AEROSOL SYSTEMS AND METHODS FOR MIXING AND DISPENSING TWO-PART MATERIALS

(75) Inventor: Lester R. Greer, Jr., Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

(21) Appl. No.: 10/389,426

(22) Filed: Mar. 14, 2003

(65) Prior Publication Data

US 2003/0183651 A1 Oct. 2, 2003

Related U.S. Application Data

(60) Provisional application No. 60/364,946, filed on Mar. 14, 2002.

(51) Int. Cl.[7] ..... B65B 3/04

(52) U.S. Cl. ..... 222/136; 222/129; 222/1; 141/3; 141/9; 141/20; 141/100; 141/375

(58) Field of Search ..... 222/1, 129, 136, 222/145.1; 141/3.9, 20, 100, 375

(56) References Cited

U.S. PATENT DOCUMENTS

| | | | | |
|---|---|---|---|---|
| 3,181,737 A | | 5/1965 | Chaucer | 222/136 |
| 3,255,924 A | | 6/1966 | Modderno | |
| 3,291,348 A | | 12/1966 | Chibret et al. | 222/145 |
| 3,343,718 A | | 9/1967 | Siegel et al. | 222/1 |
| 3,698,453 A | | 10/1972 | Morane et al. | 141/349 |
| 4,613,061 A | | 9/1986 | Meuresch et al. | |
| 4,635,822 A | | 1/1987 | Klawitter | |
| 4,779,763 A | | 10/1988 | Klawitter | |
| 4,893,730 A | | 1/1990 | Bolduc | |
| 4,969,579 A | | 11/1990 | Behar | |
| 4,988,017 A | | 1/1991 | Schrader et al. | |
| 5,052,585 A | | 10/1991 | Bolduc | |
| 5,405,051 A | | 4/1995 | Miskell | |
| 6,435,231 B1 | * | 8/2002 | Cooper et al. | 141/346 |

* cited by examiner

*Primary Examiner*—J. Casimer Jacyna
(74) *Attorney, Agent, or Firm*—Michael R. Schacht; Schacht Law Offices, Inc.

(57) ABSTRACT

An aerosol system or method for mixing first and second materials. The system comprises first and second container assemblies and a coupler. The first container assembly contains the second material and a propellant material that pressurizes the second material. The second container assembly contains the second material. The coupler is arranged to couple the first and second container assemblies, thereby forcing the second material into the second container assembly such that the first and second materials mix. The resulting mixture may then be dispensed from the second container assembly using an actuator member. In one case, the first container assembly comprises a male-type valve assembly and the second container assembly comprises a female type valve assembly. In another case, the first material is a catalyst and the second material is a pigmented liquid, which, when mixed, are suitable for repairing a damaged surface.

25 Claims, 5 Drawing Sheets

AEROSOL SYSTEMS AND METHODS FOR MIXING AND DISPENSING TWO-PART MATERIALS

RELATED APPLICATIONS

This application claims priority of U.S. Provisional Patent Application Ser. No. 60/364,946 filed Mar. 14, 2002.

TECHNICAL FIELD

The present invention relates to aerosol systems and methods for mixing and dispensing hardenable materials and, more specifically, to aerosol systems and methods for mixing and dispensing hardenable materials appropriate for repairing damaged surfaces.

BACKGROUND OF THE INVENTION

Many materials are originally formulated in a liquid or semi-liquid form for application, shaping, molding, or the like and then allowed to solidify or harden. For example, plastics and metals are heated such that they take on a liquid or malleable form and then solidify as they cool. Paints and other water or oil-based coating materials solidify to obtain a hard surface when exposed to air.

The present invention relates to thermosetting resins containing epoxy groups that, when blended or mixed with other chemicals, solidify or harden to obtain a strong, hard, chemically resistant coating, adhesive or the like. The present invention is of particular advantage when embodied as a repair system for ceramic, fiberglass, or other hard surfaces, and that application of the present invention will be described herein in detail. However, the present invention may have application to the mixing and dispensing of any two materials; the scope of the present invention should thus be determined by the claims appended hereto and not the following detailed description of the invention.

Hard surfaces such as ceramic or fiberglass may be scratched or chipped. These surfaces cannot practically be repaired using water or oil based coatings, so two part epoxy materials are typically used to repair smooth hard surfaces such as ceramic or fiberglass. Two part materials are typically manufactured and sold in two separate containers (e.g., squeeze tubes or small buckets). The materials that are combined to form a repair material will be referred to as A and B materials in the following discussion.

Appropriate quantities of the A and B materials are conventionally removed or dispensed from the two separate containers and mixed immediately prior to application. Once the A/B mixture is formed, the materials must be applied before the mixture hardens. Typically, a brush, spatula, scraper, or the like is used to apply the A/B mixture to the surface to be repaired. A surface repaired as just described will typically function adequately. In addition, the color of the repaired surface may match the color of the non-repaired surface.

However, the surface being repaired is typically formed by spraying or dipping, resulting is a smooth finish. Matching of the existing surface texture using conventional systems and methods of mixing and dispensing two-part materials is difficult. The conventional systems and methods for mixing and dispensing two-part materials further require mixing plates or pans and other application tools that must be cleaned or disposed of after use.

A goal of the present invention is to provide a system or method for mixing and dispensing a two-part material that yields a smooth finish surface while minimizing clean-up concerns.

SUMMARY OF THE INVENTION

The present invention may be embodied as an aerosol system or method for mixing first and second materials. The system comprises first and second container assemblies and a coupler. The first container assembly contains the second material and a propellant material that pressurizes the second material. The second container assembly contains the second material. The coupler is arranged to couple the first and second container assemblies, thereby forcing the second material into the second container assembly such that the first and second materials mix. The resulting mixture may then be dispensed from the second container assembly using an actuator member.

In one embodiment, the first container assembly comprises a male-type valve assembly and the second container assembly comprises a female type valve assembly. In this case, the coupler is configured to accommodate the male and female-type valve assemblies.

In another embodiment, the first material is a catalyst and the second material is a pigmented liquid, which, when mixed, are suitable for repairing a damaged surface. In this case, an actuator member is used to enable the mixture of the catalyst and the pigmented liquid to be dispensed in spray form onto the damaged surface. The spray form more closely matches the pre-existing smooth factory surface finish.

DETAILED DESCRIPTION OF THE INVENTION

Figure 1:
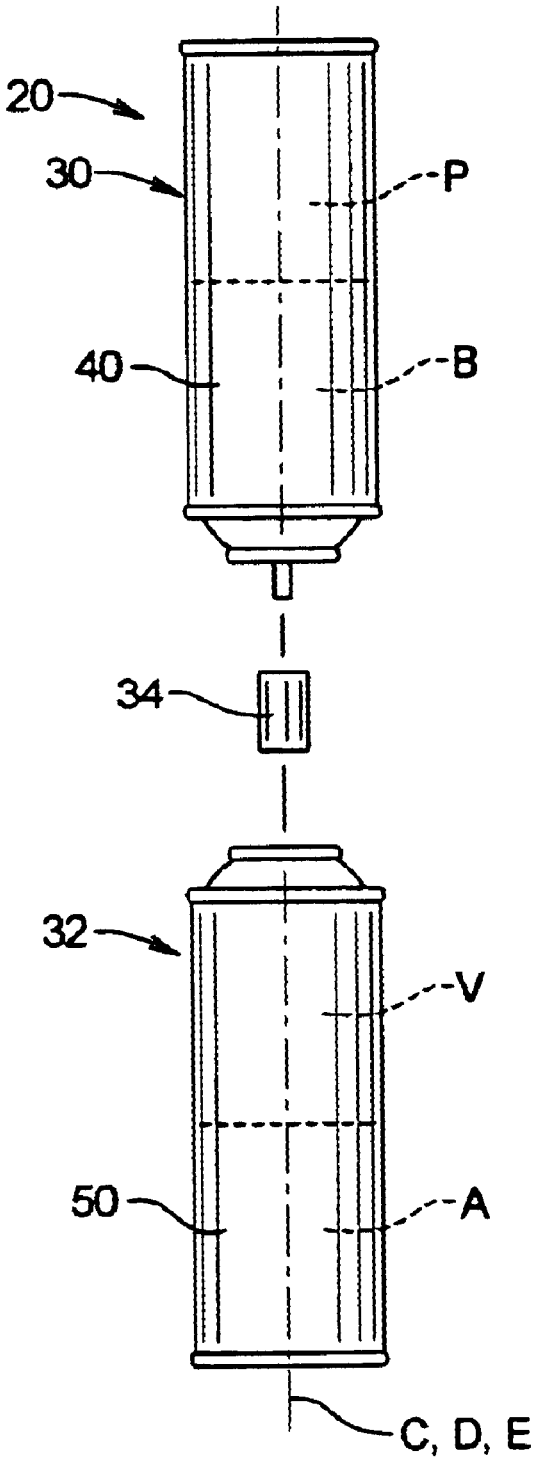
FIG. 1 is a front elevation view depicting a portion of a first embodiment of a mixing and dispensing system constructed in accordance with, and embodying the principals in the present invention.
Figure 2:
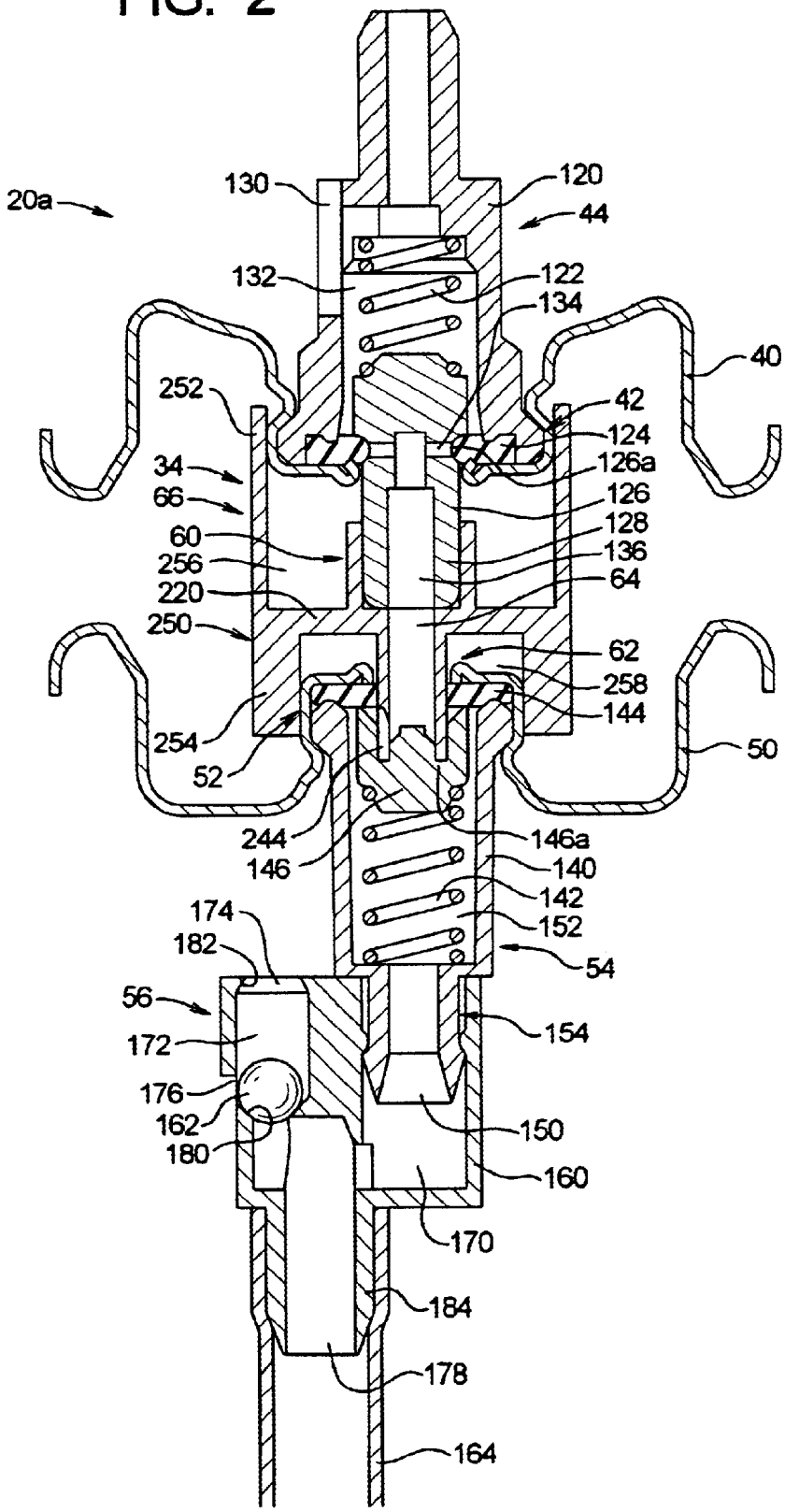
FIGS. 2 and 3 are section views depicting the system of FIG. 1 in premix and mix configurations.
Figure 3:
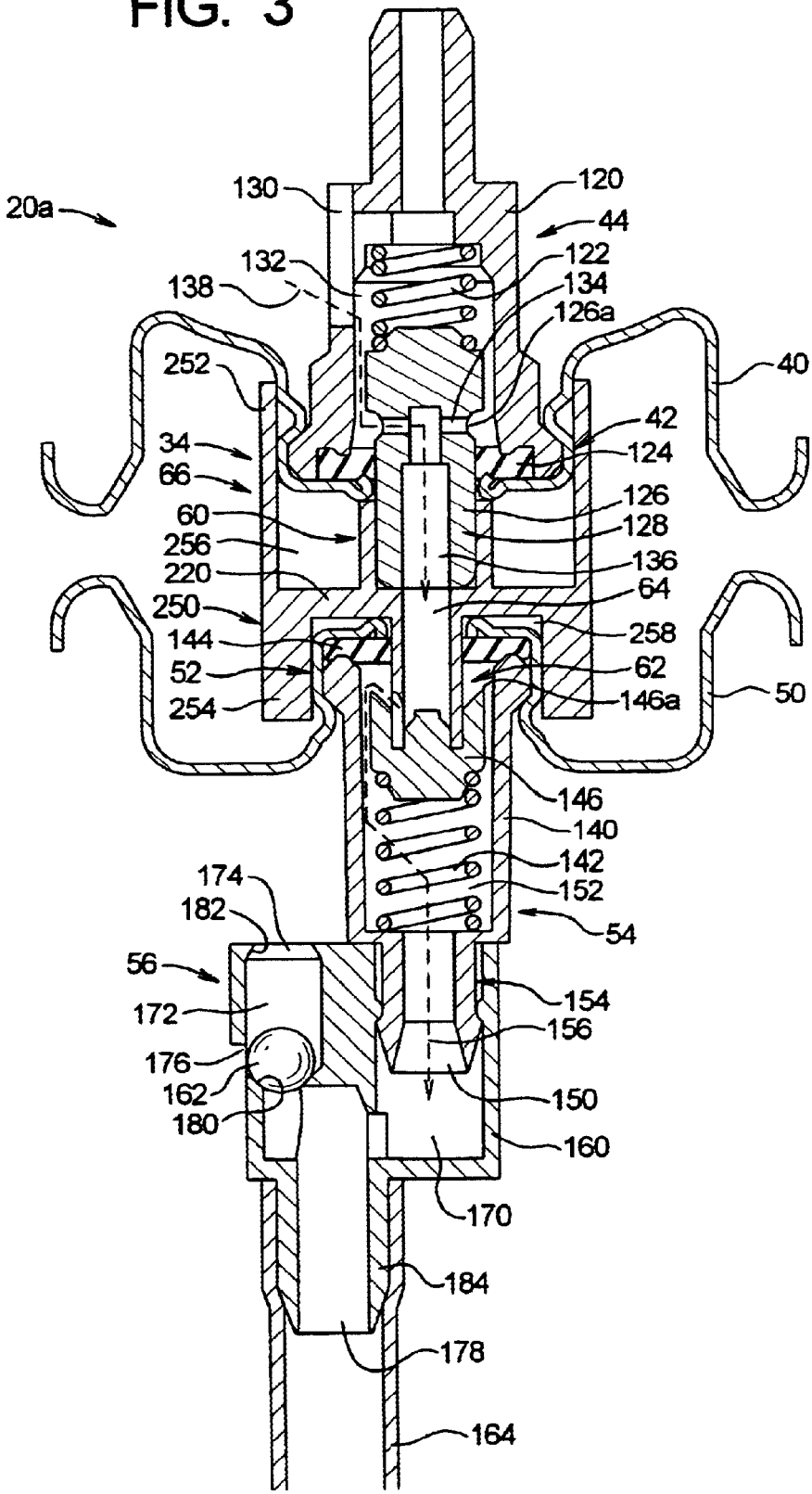
Figure 4:
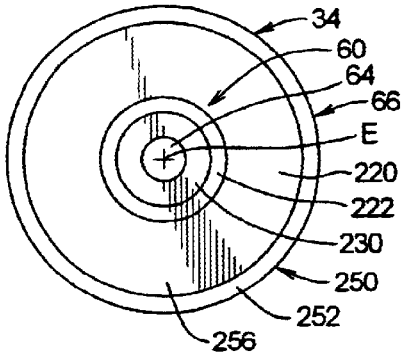
FIG. 4 is a top plan view of an exemplary coupler member of the system of FIG. 1.
Figure 5:
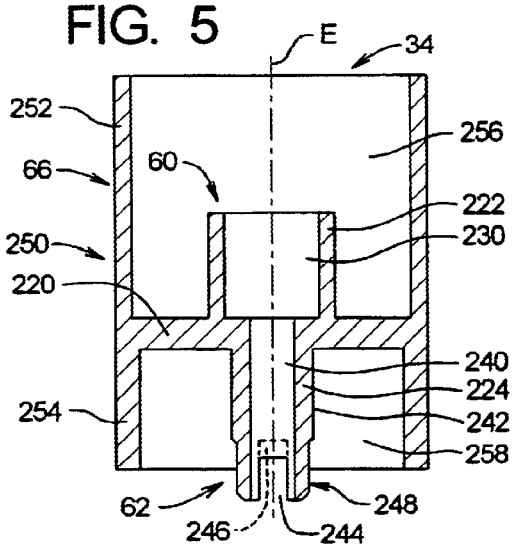
FIGS. 5 and 6 are section views depicting the coupler member of FIG. 4.
Figure 7:
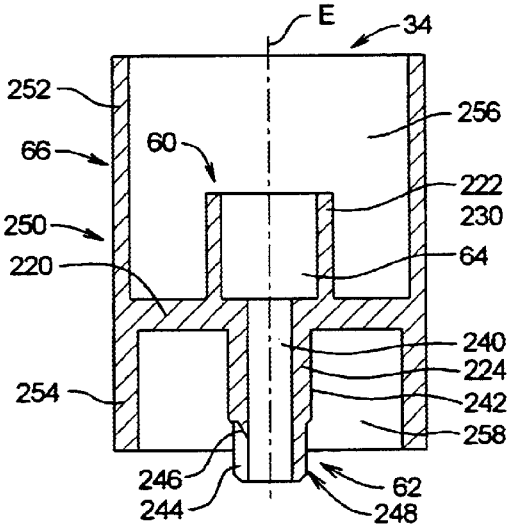
FIG. 7 is a top plan view of the coupler member of FIG. 4.
Figure 8:
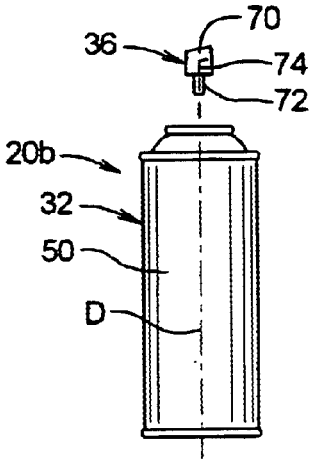
FIG. 8 is a front elevation view depicting the mixing and dispensing system of the present invention in a dispensing configuration.

Referring initially to FIGS. 1 and 8 of the drawing, depicted at 20 therein is a mixing and dispensing system constructed in accordance with, and embodying, the principals of the present invention. In FIG. 1, the mixing and dispensing system of the present invention is shown in a pre-mixing configuration; FIGS. 2 and 3 show a portion of the system 20 in a mixing configuration, which is identified by reference character 20*a*. In FIG. 8, the mixing and dispensing system is shown in a dispensing configuration identified by reference character 20*b*.

As shown in FIGS. 1 and 8, the exemplary mixing and dispensing system 20 comprising a first container assembly 30 (FIG. 1), a second container assembly 32, an coupler member 34 (FIG. 1), and an actuator member 36 (FIG. 8).

The mixing and dispensing system 20 is adapted to mix materials represented by reference characters A and B. The material B is contained by the first container assembly 30, and the material A is contained by the second container assembly 32.

The first container assembly 30 is pressurized as indicated by reference character P. Typically, the material B contains or is mixed with a liquid propellant material that gassifies under appropriate pressures and temperatures to pressurize the contents of the first container assembly 30 as indicated by reference character P. Other pressurizing techniques may be appropriate for different materials; for example, an inert gas may be forced into the first container assembly 30 to pressurize the contents of this container. In contrast, a partial vacuum is established in the second container assembly 32 as indicated by reference character V.

When the system 20 is in the mixing configuration 20*a*, the coupler member 34 connects the first and second container assemblies to allow transfer of the material B to the second container assembly 32 where the material B is mixed with the material A. At the same time, a portion of the propellant material in liquid form is also transferred to the second container assembly 32 such that the second container assembly contains some of the propellant material in addition to the A/B mixture; the second container assembly 32 is thus pressurized after the A/B mixture is formed therein. The actuator member 36 is then placed on the second container assembly 32 to allow the A/B mixture to be dispensed from this container assembly 32 in a conventional manner.

With the foregoing basic understanding of the present invention in mind, the details of construction and operation of this invention will now be described.

As perhaps best can be seen with reference to FIGS. 1–3, the first container assembly 30 comprises a first container 40 defining a first neck portion 42 and a first valve assembly 44. The first container assembly 30 further defines a first container axis C. The second container assembly 32 comprises a second container 50 defining a second neck portion 52, a second valve assembly 54, and dip tube assembly 56. The second container assembly 32 defines a second container axis D.

The valve assemblies 44 and 54 are rigidly connected to the neck portions 42 and 52 of the containers 40 and 50. So assembled, the valve assemblies 44 and 54 selectively create or block a fluid path between the interior and exterior of the containers 40 and 50. The operation of the dip tube assembly 56 will be described in further detail below.

Referring now to FIGS. 4–7, it can be seen that the coupler member 34 comprises a first connection portion 60 and a second connecting portion 62. The coupler member 34 further defines a coupler passageway 64 extending between the first and second connecting portion 60 and 62. An adapter axis E extends through the coupler member 34. The exemplary coupler member 34 further comprises a stabilizing structure 66 the purpose of which will be described in further detail below.

Figure 6:
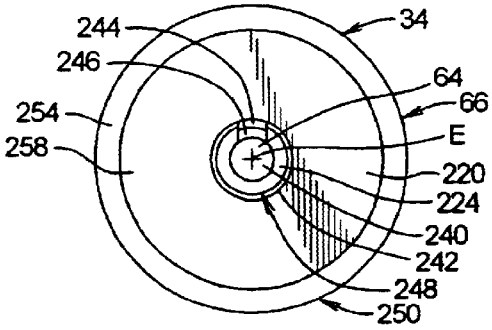

The first connection portion 60 of the coupler member 34 is sized and dimensioned to engage the first valve assembly 44, while the second connecting portion 62 is sized and dimensioned to engage the second valve assembly 54. The coupler member 34 engages the first and second valve assemblies 44 and 54 such that the axes C, D, and E are aligned as shown in FIG. 6. The first and second containers 40 and 50 are displaced towards each other along the aligned axes C, D, and E. The coupler member 34 causes the first and second valve assemblies 44 and 54 to open, thereby allowing fluid to flow between the first container assembly 30 and the second container assembly 32.

The exemplary actuator member 36 is or may be conventional and comprises a button portion 70 and a stem portion 72. The stem portion 72 is sized and dimensioned to engage the second valve assembly 54 such that depressing the button portion 70 towards the second container 50 causes the second valve assembly 54 to open, thereby allowing fluid to flow out of the second container assembly 32 through the actuator passageway 74.

Referring now to FIGS. 2 and 3, the valve assemblies 44 and 54, and the interaction of these valve assemblies with the coupler member 34, will be described in further detail. The first valve assembly 44 comprises a first valve housing 120, a first valve spring 122, a first valve seat 124, and a first valve member 126 defining a stem portion 128. The valve housing 120 defines a first housing opening 130 and a first housing chamber 132. The first valve member 126 defines a lateral passageway 134 and an axial passageway 136. The first valve spring 122 and a portion of the first valve member 126 are arranged in the first housing chamber 132. The valve seat 124 is held against the container 40 by the housing 120. The stem portion 128 of the first valve member 126 extends out of the first housing chamber 132.

The valve spring 122 is configured to bias the valve member 126 out of the housing chamber 132 (downward in FIGS. 2 and 3). However, applying a force on the valve member 126 against the biasing force of the spring 122 causes the valve member 126 to move from the closed position shown in FIG. 2 to the open position shown in FIG. 3. When the valve member 126 is in the closed position as shown in FIG. 2, the valve seat 124 enters a seat groove 126*a* in the valve member 126. When the valve seat 124 is in the groove 126*a*, the lateral passageway 134 is blocked, thereby blocking the first valve path 138.

However, when the valve member 126 is in the open position as shown in FIG. 3, the valve member 126 is displaced such that the groove 126*a* disengages from the valve seat 124, thereby unblocking the lateral passageway 134 and opening the first valve path 138.

The second valve assembly 54 comprises a second valve housing 140, a second valve spring 142, a second valve seat 144, and a second valve member 146. The valve housing 140 defines a second housing opening 150 and a second housing chamber 152. The valve housing 140 also comprises a bayonette portion 154.

The valve spring 142 and valve member 146 are arranged within the housing chamber 152. The valve seat 144 is held between the valve housing 140 and the container 50.

The valve spring 142 biases the valve member 146 against the valve seat 144 when the valve asembly 54 is in its closed position as shown in FIG. 2. However, displacing the valve member 146 against the biasing force of the spring 142 disengages the valve member 146 from the valve seat 144. When the valve member 146 is disengaged from the valve seat 144, a second valve path 156 is established that allows fluid to flow into and/or out of the container 50.

Given the foregoing description of the first and second valve assemblies 44 and 54, it should be clear that the first valve asembly 44 is what may be characterized as a male valve assembly in that the stem portion 128 of the first valve member 126 extends out of the first housing chamber and the first container 40.

The second valve assembly 54 may be characterized as a female valve assembly in that the second valve member 146 lies entirely within the second housing chamber 152. Conventionally, a stem portion of an actuator, such as the stem portion 72 of the actuator member 36, extends into the second housing chamber to engage the second valve member 146. Again conventionally, depressing the second portion 70 displaces the stem portion 72 and thus lifts the valve member 146 from the valve seat 144.

As briefly discussed above, both of the first and second container assemblies 30 and 32 are or may be conventional, and suitable container assemblies are available on the market without modification. In addition, as will be discussed in further detail below, these valve assemblies are sized and dimensioned to allow fluid flow rates that allow the effective and efficient transfer of the material B from the first container assembly 30 into the second container assembly 32.

FIGS. 2 and 3 also depict the details of the dip tube assembly 56. The dip tube assembly 56 comprises a check valve housing 160, a check valve member 162, and a dip tube 164. The check valve housing 160 defines a bayonette chamber 170, a ball chamber 172, a first ball opening 174, a second ball opening 176, and a dip tube opening 178. First and second check valve seats 180 and 182 are formed on the check valve housing within the ball chamber 172.

The bayonette chamber 170 receives the bayonette portion 154 of the second valve housing 140. The dip tube 164 is connected to a similar bayonette portion 184 of the check valve housing 160. An unobstructed fluid flow path extends between the bayonette chamber 170 and the dip tube opening 178. Accordingly, when the system 20 is in its dispensing configuration 20*b*, fluid at the bottom of the second container 50 flows up through the dip tube 164, the check valve housing 160, through the second valve assembly 54, and out through the actuator passageway 74.

Defined by the check valve housing 160 are first and second check valve seats 180 and 182. When the system 20 is in the mixing configuration 20*a*, the pressure P within the first container assembly 30 and vacuum V in the second container assembly 32 forces the check valve member 162 against the first check valve seat 180. In this configuration, the material B flows into the second container assembly 32 through the second ball opening 176. The second ball opening 176 is sized and dimensioned to allow a relatively high rate of flow of the material B into the second container assembly 32; this relatively high flow rate decreases the time that the system 20 must be kept in the mixing configuration 20*a*.

When the system 20 is in the dispensing configuration 20*b*, gravity forces the check valve member 162 against the second check valve seat 182. Propellant material within the second container assembly 32 thus does not flow directly out of the container 50; instead, when the second valve assembly 54 is in the open configuration, the propellant material forces the A/B mixture through the dip tube 164, the second valve assembly 54, and out through the actuator member 36.

Turning now to FIGS. 4–7, the coupler member 34 will now be described in further detail. The coupler member 34 comprises a center plate 220 from which extends first and second connecting projections 222 and 224. The first and second connecting projections 222 and 224 of the exemplary coupler member 34 define the first and second connecting portions 60 and 62.

The first connecting projection 222 defines a connecting chamber 230 that, as shown in FIGS. 2 and 3, is sized and adapted to receive the stem portion 128 of the first valve member 126. When the stem portion 128 is received by the connecting chamber 230, the coupler passageway 64 of the coupler member 34 is in fluid communication with the axial passageway 136 of the first valve member 126.

The second connecting projection 224 defines a connecting bore 240 and an outer surface 242. A connecting notch 244 is formed in the projection 224, and a beveled surface 246 is formed on the outer surface 242 directly above the notch 244. The projection 224 further defines a reduced diameter portion 248 at its distal end away from the center plate 220. The second connecting projection 224 is sized and adapted to be received by a stem seat 146*a* of the second valve member 146. With the projection 224 so received, the connecting bore 240 is in fluid communication with the second housing chamber 152 when the second valve assembly 54 is in the open configuration.

The coupler passageway 64 extends along the connecting chamber 230 and the connecting bore 240 through the center plate 220. Accordingly, when both valve assemblies 44 and 54 are in their open configurations, the first valve path 138 and second valve path 156 are connected by the coupler passageway 64. The valve assemblies 44 and 54 are placed into their open configurations by inserting the stem portion 128 of the first valve member 126 into the connecting chamber 230, inserting the second connecting projection 224 into the stem seat 146*a* of the second valve member 146, and forcing the containers 40 and 50 toward each other.

The exemplary stabilizing structure 66 is formed by a stabilizing housing 250 having first and second stabilizing walls 252 and 254. The first stabilizing wall defines a first stabilizing chamber 256, while the second stabilizing wall 254 defines a second stabilizing chamber 258. The first and second connecting projections 222 and 224 are located within the first and second stabilizing chambers 256 and 258, respectively.

When the system 20 is in the mixing configuration 20*a*, the first neck portion 42 of the first container 40 is received within the first stabilizing chamber 256, and the second neck portion 52 of the second container 40 is similarly received within the second stabilizing chamber 256. The first stabilizing wall 252 thus engages the first neck portion 42 and the second stabilizing wall 252 engages the second neck portion 52 to inhibit relative movement between the container assemblies 30 and 32 except along the aligned axes C, D, and E.

The optional stabilizing housing 250 thus allows the container assemblies 30 and 32 to move towards each other along the aligned axes C, D, and E, but inhibits pivoting or rocking motion of one container assembly relative to the other while the materials A and B are being mixed.

With the foregoing understanding of the exemplary structures used to carry out the principles of the present invention, one exemplary method of carrying out the present invention will now be described. If a given step is not required to implement the present invention in its broadest form, that step will be identified as an optional step.

Optional initial steps are to warm the first container assembly 30 and/or to cool the second container assembly 32. Warming the first container assembly 30 increases the pressure P on the material B. Cooling the second container assembly 32 increases the partial vacuum V within the second container assembly 32. While not required, these optional initial steps will increase the pressure differential between the two container assemblies 30 and 32 and thus the rate at which the material B is transferred from the first container assembly 30 to the second container assembly 32.

A second optional step is to shake the first container assembly 30. If the material B includes a liquid propellant, shaking the assembly 30, and thus the material B, encourages gassification of the propellant. The gassified propellant increases the pressure on the material B, which will in turn decrease material transfer time.

At this point, the coupler member 34 is attached to the first and second container assemblies 30 and 32 as shown above with reference to FIGS. 2 and 3. Preferably, the coupler member 34 is first placed on the first container assembly 30. The combination of the first container assembly 30 and coupler member 34 is then inverted.

The first container assembly 30 is then displaced downwardly relative to the second container assembly 32 with the axes C, D, and E aligned until the coupler member 34 engages the second container assembly 32 as shown in FIG. 2. Continued movement of the first container assembly 30 towards the second container assembly 32 causes the first and second valve assemblies 44 and 54 to open as shown in FIG. 3.

The first and second container assemblies 30 and 32 are then held relative to each other until the combination of the pressure P in the first container assembly 30 and the partial vacuum V in the second container assembly 32 causes the material B to flow from the first container assembly 30 into the second container assembly 32. The system 20 described herein allows the material B to be transferred to the second container assembly 32 in approximately one minute. The material B mixes with the material A as the material B enters the second container assembly 32.

When the transfer is complete, the first container assembly 30 and coupler member 34 are removed from the second container assembly 32. The actuator member 36 is then connected to the second container assembly 32 as shown in FIG. 8, preferably immediately after the coupler member 34 has been detached.

The combination of the second container assembly 32 and actuator member 36 may then be used to dispense the A/B mixture. If the A/B mixture is an epoxy or other binary chemical system, use of the combination of the second container assembly 32 and actuator member 36 is optionally delayed for a predetermined time period to allow for the appropriate chemical reaction.

One preferred exemplary implementation of the present invention is as a dispensing and mixing system for a two-part epoxy material for repairing cracked or chipped ceramic plumbing fixtures such as sinks, bathtubs, commodes, or the like. In this case, the material A is a clear catalyst and the material B is a mixture of a liquid propellant and a pigmented liquid, typically white or almond in color. The propellant is partially in a liquid phase and partially in a gaseous phase.

Set forth below are several tables that define certain variable parameters of the exemplary system 20 described herein. When these tables contain numerical limitations, the table includes a preferred value and first and second preferred ranges. The preferred values are to be read as "approximately" the listed value. The first and second preferred ranges are to be read as "substantially within" the listed range. In addition, the preferred ranges may be specifically enumerated or may be identified as plus or minus a certain percentage. In this case, the range is calculated as a percentage of, and is centered about, the preferred value.

The following Table A lists typical ingredients by percentage weight of the material A when the present invention is embodied as a surface repair system for ceramic, fiberglass, and other surfaces.

TABLE A

| Ingredient | Exemplary Preferred Embodiment | First Preferred Range | Second Preferred Range |
|---|---|---|---|
| 1-methoxy-2-propanol | 32.97 | ±5% | ±10% |
| butoxyethanol ethylene glycol monobutyl ether | 20.16 | ±5% | ±10% |
| dipropylene glycol methyl ether | 2.16 | ±5% | ±10% |
| toluene | 0.21 | ±5% | ±10% |
| 2-propanol | 0.07 | ±5% | ±10% |

The following Table B lists typical ingredients by percentage weight of the material B when the present invention is embodied as a repair system for ceramic, fiberglass, and other surfaces.

TABLE B

| Ingredient | Exemplary Preferred Embodiment | First Preferred Range | Second Preferred Range |
|---|---|---|---|
| z-butoenthanol ethylene glycol monobutyl ether | 18.85 | ±5% | ±10% |
| polyanide | 14.40 | ±5% | ±10% |
| dipropylene glycol methyl ether | 10.67 | ±5% | ±10% |
| 1-methoxy-2-propanol | 6.92 | ±5% | ±10% |
| antisettling agent | 5.21 | ±5% | ±10% |
| aromatic hydrocarbon | 2.81 | ±5% | ±10% |
| solvent dispersion | 0.05 | ±5% | ±10% |
| propellant material | 40.85 | ±5% | ±10% |

The following Table C lists liquid propellants appropriate for use with a repair system for ceramic, fiberglass, and other surfaces of the present invention. Typical proportions of these propellants by percentage weight when mixed with the material B are identified in the last row of Table B.

TABLE C

| | PROPELLANT |
|---|---|
| Exemplary Preferred Embodiment | Dimethyl Ether |
| First Preferred Alternative | A-70 |
| Additional Preferred Alternative | Propane Isobutane |

The following Table D lists typical proportions by weight of the materials A and B and propellant when the present invention is embodied as a ceramic repair system.

TABLE D

| Embodiment | Material A | Material B | Propellant |
|---|---|---|---|
| Preferred | 28% | 34% | 38% |
| First Preferred Range | 26–30% | 32–36% | 36–40% |
| Second Preferred Range | 20–36% | 24–42% | 30–56% |

The following Table E lists typical numbers and ranges of numbers for certain dimensions of the physical structure of the present invention when optimized for implementation as a ceramic repair system. These dimensions are quantified as approximate minimal cross-sectional areas of fluid paths such as bores, openings, notches, or the like in a direction perpendicular to fluid flow.

In the preferred embodiments, only such one fluid path may be shown, but a plurality of these paths in parallel may be used. In this case, the value listed in Table E represents the total of all of the cross-sectional areas created by the plurality of fluid paths.

In addition, Table E includes linear dimensions corresponding to diameters of certain circular openings. The effective cross-sectional area can easily be calculated from the diameter. Although circular cross-sectional areas are typically preferred, other geometric shapes may be used. The use of linear dimensions representing diameters in Table E thus should not be construed as limiting the scope of the present invention to circular fluid paths.

TABLE E

| Preferred Structure | Exemplary Preferred Embodiment | First Preferred Range | Second Range |
|---|---|---|---|
| actuator passageway 74 | 0.014" | 0.010–0.018" | 0.010–0.026" |
| afirst housing opening 130 | 0.0063 $in^2$ | ±5% | ±10% |
| lateral passageway 136 | 0.175" | ±1% | ±5% |
| axial passageway 136 | 0.073" | ±1% | ±5% |
| second housing opening 150 | 0.090" | ±1% | ±5% |
| first ball opening 174 | 0.116" | ±1% | ±5% |
| second ball opening 176 | 0.083" | ±1% | ±5% |
| dip tube opening 178 | 0.126" | ±1% | ±5% |
| connecting bore 240 | 0.085" | ±0.5% | ±1% |
| connecting notch 244 | 0.050" | ±0.5% | ±1% |

When implemented as a repair system as just described, the method described above preferably includes the optional steps of shaking the first container assembly 30, allowing the A/B mixture to sit for approximately one hour after the actuator member 36 is placed thereon and before use, and refrigerating the A/B mixture in the second container assembly to extend the life of the A/B mixture between uses. Again, however, these steps are optional, and the present invention may be implemented in forms not including these steps.

Figure 9:
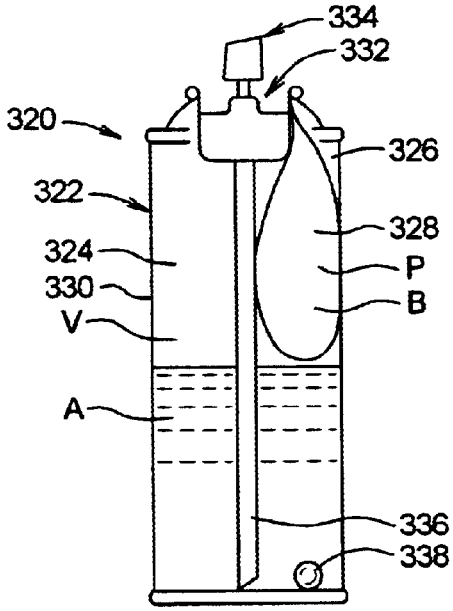
FIG. 9 is a section view of a second embodiment of a mixing and dispensing system of the present invention.

Referring now to FIG. 9, depicted therein is an aerosol system 320 constructed in accordance with, and embodying, yet another embodiment of the present invention. The aerosol system 320 is adapted to mix and dispense two materials. Like the system 20 described above, the system 320 is perhaps preferably used to combine two parts A and B of an epoxy material; this system 320 is of particular significance when the epoxy material is a ceramic repair material as described above, but other materials may be dispensed from the system 320.

The system 320 comprises an aerosol container assembly 322 defining a container chamber 324 and a material bag 326 defining a bag chamber 328. The container assembly 322 is or may be conventional and comprises a container 330, a valve assembly 332, an actuator member 334, a dip tube 336, and an exemplary piercing member 338.

The B part of the epoxy material and a propellant material are contained by the material bag 326 within the bag chamber 328. The bag 326 is secured by the attachment of the valve assembly 332 onto the container 330. For shipping and storage prior to use, the bag chamber 328 is sealed from the container chamber 324, and a pressure P is maintained by the gaseous phase propellant material in the bag chamber 328. At the same time, the material B is placed in the container chamber 324, and a vacuum V is also established in the chamber 324.

When the system 320 is to be used, the material bag 326 is pierced to allow the materials A and B to mix within the container chamber 324. The bag 326 may be pierced by any appropriate means. For example, spinning the valve assembly 332 relative to the container 330 could be used to pierce the material bag 326. The exemplary system 320 comprises a piercing member 338 in the form of a ball within the container chamber 324. Shaking the aerosol assembly 320 will cause the ball 338 to engage and rupture the material bag 326 and thereby allow the materials A and B to mix. The system 320 has the advantage of only comprising a single container. As should be clear to one of ordinary skill in the art, the present invention may be embodied in forms other than those described above.

What is claimed is:

1. An aerosol system for mixing first and second materials, comprising:

a first container assembly comprising a first container for containing the second material and a propellant material that pressurizes the second material, and a first valve assembly operable in an open configuration and closed configuration, the first valve assembly comprising a first valve housing defining a first housing chamber, and a first valve member defining a valve stem portion, where the first valve member is partly arranged within the first housing chamber with the valve stem portion extending out of the first valve chamber;

a second container assembly comprising a second container for containing the first material, and a second valve assembly operable in an open configuration and a closed configuration, the second valve assembly comprising a second valve housing defining a second housing chamber, and a second valve member that defines a stem seat and is arranged substantially within the second housing chamber; and a coupler comprising first and second connecting portions, where the first connecting portion of the coupler defines a connecting chamber adapted to receive the valve stem portion of the first valve member; and the second connecting portion of the coupler defines a coupler stem portion, where the stem seat of the second valve member is adapted to received the coupler stem portion; whereby when the first and second connecting portions engage the first and second valve assemblies and the first and second container assemblies are displaced towards each other, the first and second valve assemblies are placed in the open configuration to allow a portion of the propellant material and at least a portion of the second material to flow into the second container such that the first and second materials are mixed in the second container; and the mixture of the first and second materials is dispensed from the second container through the second valve assembly.

2. An aerosol system as recited in claim 1, in which the first container further contains a partial vacuum before the first and second connecting portions engage the first and second valve assemblies and the first and second container assemblies are displaced towards each other.

3. An aerosol system as recited in claim 1, further comprising an actuator member comprising a stem portion, where the stem portion engages the second valve assembly such that displacing the stem portion places the second valve assembly in the open configuration.

4. An aerosol system as recited in claim 1, in which the second container assembly further comprises a dip tube that allows fluid flow from a bottom of the second container to the second valve assembly.

5. An aerosol system as recited in claim 1, in which the second container assembly further comprises a dip tube assembly comprising:

a check valve housing secured to the second valve assembly;

a dip tube that extends between the check valve housing and a bottom of the second container; and a check valve member arranged within the check valve housing to improve flow of the portion of the propellant material and the at least a portion of the second material into the second container.

6. An aerosol system as recited in claim 5, in which the check valve member is adapted to allow the portion of the propellant material and the at least a portion of the second material to flow through an opening in the check valve housing when a pressure within the first container assembly is higher than a pressure within the second container assembly.

7. An aerosol system as recited in claim 1, in which the coupler comprises a stabilizing structure for mechanically engaging the first and second container assemblies when the first and second connecting portions engage the first and second valve assemblies.

8. An aerosol system for repairing a surface, comprising:

a first container assembly comprising a first container for containing a pigmented liquid and a propellant material that pressurizes the pigmented liquid, and a first valve assembly operable in an open configuration and a closed configuration;

a second container assembly comprising a second container for containing a catalyst, and a second valve assembly operable in an open configuration and a closed configuration; and a coupler comprising first and second connecting portions adapted to engage the first and second valve assemblies, respectively; and an actuator member comprising a stem portion; whereby when the first and second connecting portions engage the first and second valve assemblies, respectively, and the first and second container assemblies are displaced towards each other, the first and second valve assemblies are placed in the open configuration to allow a portion of the propellant material and at least a portion of the pigmented liquid to flow into the second container such that the catalyst and the pigmented liquid are mixed in the second container; and the mixture of the catalyst and the pigmented liquid is dispensed by engaging the stem portion of the actuator member with the second valve assembly and displacing the stem portion to place the second valve assembly in the open configuration.

9. An aerosol system as recited in claim 8, in which the first container further contains a partial vacuum before the first and second connecting portions engage the first and second valve assemblies and the first and second container assemblies are displaced towards each other.

10. An aerosol system as recited in claim 8, in which:

the first valve assembly comprises a first valve housing defining a first housing chamber, and a first valve member defining a valve stem portion, where the first valve member is partly arranged within the first housing chamber with the valve stem portion extending out of the first valve chamber;

the second valve assembly comprises a second valve housing defining a second housing chamber, and a second valve member that defines a stem seat and is arranged substantially within the second housing chamber; wherein the first connecting portion of the coupler defines a connecting chamber adapted to receive the valve stem portion of the first valve member; and the second connecting portion of the coupler defines a coupler stem portion, where the stem seat of the second valve member is adapted to received the coupler stem portion.

11. An aerosol system as recited in claim 8, in which the second container assembly further comprises a dip tube that allows fluid flow from a bottom of the second container to the second valve assembly.

12. An aerosol system as recited in claim 8, in which the second container assembly further comprises a dip tube assembly comprising:

a check valve housing secured to the second valve assembly;

a dip tube that extends between the check valve housing and a bottom of the second container; and a check valve member arranged within the check valve housing to improve flow of the portion of the propellant material and the at least a portion of the pigmented liquid into the second container.

13. An aerosol system as recited in claim 8, in which the coupler comprises a stabilizing structure for mechanically engaging the first and second container assemblies when the first and second connecting portions engage the first and second valve assemblies.

14. A method of mixing first and second materials, comprising the steps of:

providing a first container assembly comprising a first container and a first valve assembly operable in open and closed configurations, where the first valve assembly comprises a first valve housing defining a first housing chamber, and a first valve member defining a valve stem portion, where the first valve member is partly arranged within the first housing chamber with the valve stem portion extending out of the first valve chamber;

providing a second container assembly comprising a second container and a second valve assembly operable in open and closed configurations, where the second valve assembly comprises a second valve housing defining a second housing chamber, and a second valve member that defines a stem seat and is arranged substantially within the second housing chamber; and arranging the second material and a propellant material within the first container such that the propellant material pressurizes the second material;

arranging the first material within the second container;

providing a coupler comprising first and second connecting portions, where the first connecting portion of the coupler defines a connecting chamber adapted to receive the valve stem portion of the first valve member, and the second connecting portion of the coupler defines a coupler stem portion, where the stem seat of the second valve member is adapted to received the coupler stem portion;

engaging the second connecting portion with the second valve assembly;

engaging the first connecting portion with the first valve assembly;

forming a mixture of the first and second materials by displacing the first and second container assemblies towards each other to place the first and second valve assemblies in the open configuration and cause a portion of the propellant material and at least a portion of the second material to flow into the second container such that the first and second materials are mixed in the second container; and operating the second valve assembly to dispense the mixture of the first and second materials from the second container assembly.

15. A method as recited in claim 14, further comprising the step of establishing a partial vacuum within the second container assembly when the first material is arranged within the second container assembly.

16. A method as recited in claim 14, in which the step of operating the second valve assembly further comprises the steps of:

providing an actuator member comprising a stem portion; and engaging the stem portion with the second valve assembly after the step of forming the mixture; and displacing the stem portion towards the second valve assembly to place the second valve assembly in the open configuration.

17. A method as recited in claim 14, in which:

the step of providing the coupler comprises the step of providing a stabilizing structure; and the steps of engaging the first and second connecting portions with the first and second valve assemblies further comprise the step of engaging the stabilizing structure with the first and second container assemblies to stabilize a connection between the first and second connecting portions and the first and second valve assemblies, respectively.

18. A method of repairing a surface comprising the steps of:

providing a first container assembly comprising a first container, and a first valve assembly operable in an open configuration and a closed configuration;

providing a second container assembly comprising a second container, and a second valve assembly operable in an open configuration and a closed configuration; and arranging a pigmented liquid and a propellant material in the first container such that the propellant material pressurizes the pigmented liquid;

arranging a catalyst within the second container;

engaging first and second connecting portions of a coupler with the first and second valve assemblies, respectively;

forming a mixture of the catalyst and the pigmented liquid by displacing the first and second container assemblies towards each other such that the first and second valve assemblies are placed in the open configuration to allow a portion of the propellant material and at least a portion of the pigmented liquid to flow into the second container;

engaging a stem portion of an actuator member with the second valve assembly; and displacing the actuator member towards the second valve assembly to dispense the mixture onto the surface to be repaired.

19. A method as recited in claim 18, further comprising the step of establishing a partial vacuum within the second container assembly when the catalyst is arranged within the second container assembly.

20. A method as recited in claim 18, further comprising the steps of:

forming a stabilizing structure on the coupler; and engaging the stabilizing structure with the first and second container assemblies to stabilize a connection between the first and second connecting portions and the first and second valve assemblies, respectively.

21. An aerosol system for mixing first and second materials, comprising:

a first container assembly comprising a first container for containing the second material and a propellant material that pressurizes the second material, and a first valve assembly operable in an open configuration and a closed configuration, the first valve assembly comprising a first valve housing defining a first housing chamber, and a first valve member defining a valve stem portion, where the first valve member is partly arranged within the first housing chamber with the valve stem portion extending out of the first valve chamber;

a second container assembly comprising a second container for containing the first material, and a second valve assembly operable in an open configuration and a closed configuration, the second valve assembly comprising a second valve housing defining a second housing chamber, and a second valve member that defines a stem seat and is arranged substantially within the second housing chamber; and a coupler comprising first and second connecting portions, where the first connecting portion of the coupler defines a connecting chamber adapted to receive the valve stem portion of the first valve member; and the second connecting portion of the coupler defines a coupler stem portion, where the stem seat of the second valve member is adapted to received the coupler stem portion; whereby when the first and second connecting portions engage the first and second valve assemblies and the first and second container assemblies are displaced towards each other, the first and second valve assemblies are placed in the open configuration to allow a portion of the propellant material and at least a portion of the second material to flow into the second container such that the first and second materials are mixed in the second container; and the first container further contains a partial vacuum before the first and second connecting portions engage the first and second valve assemblies and the first and second container assemblies are displaced towards each other.

22. An aerosol system for mixing first and second materials, comprising:

a first container assembly comprising a first container for containing the second material and a propellant material that pressurizes the second material, and a first valve assembly operable in an open configuration and a closed configuration, the first valve assembly comprising a first valve housing defining a first housing chamber, and a first valve member defining a valve stem portion, where the first valve member is partly arranged within the first housing chamber with the valve stem portion extending out of the first valve chamber;

a second container assembly comprising a second container for containing the first material, and a second valve assembly operable in an open configuration and a closed configuration, the second valve assembly comprising a second valve housing defining a second housing chamber, and a second valve member that defines a stem seat and is arranged substantially within the second housing chamber, and a dip tube that allows fluid flow from a bottom of the second container to the second valve assembly; and a coupler comprising first and second connecting portions, where the first connecting portion of the coupler defines a connecting chamber adapted to receive the valve stem portion of the first valve member; and the second connecting portion of the coupler defines a coupler stem portion, where the stem seat of the second valve member is adapted to receive the coupler stem portion; whereby when the first and second connecting portions engage the first and second valve assemblies and the first and second container assemblies are displaced towards each other, the first and second valve assemblies are placed in the open configuration to allow a portion of the propellant material and at least a portion of the second material to flow into the second container such that the first and second materials are mixed in the second container.

23. An aerosol system for mixing first and second materials, comprising:

a first container assembly comprising a first container for containing the second material and a propellant material that pressurizes the second material, and a first valve assembly operable in an open configuration and a closed configuration, the first valve assembly comprising a first valve housing defining a first housing chamber, and a first valve member defining a valve stem portion, where the first valve member is partly arranged within the first housing chamber with the valve stem portion extending out of the first valve chamber;

a second container assembly comprising a second container for containing the first material, and a second valve assembly operable in an open configuration and a closed configuration, the second valve assembly comprising a second valve housing defining a second housing chamber, a second valve member that defines a stem seat and is arranged substantially within the second housing chamber, and a dip tube assembly comprising a check valve housing secured to the second valve assembly, a dip tube that extends between the check valve housing and a bottom of the second container, and a check valve member arranged within the check valve housing to improve flow of the portion of the propellant material and the at least a portion of the second material into the second container; and a coupler comprising first and second connecting portions, where the first connecting portion of the coupler defines a connecting chamber adapted to receive the valve stem portion of the first valve member; and the second connecting portion of the coupler defines a coupler stem portion, where the stem seat of the second valve member is adapted to received the coupler stem portion; whereby when the first and second connecting portions engage the first and second valve assemblies and the first and second container assemblies are displaced towards each other, the first and second valve assemblies are placed in the open configuration to allow a portion of the propellant material and at least a portion of the second material to flow into the second container such that the first and second materials are mixed in the second container.

24. An aerosol system as recited in claim 23, in which the check valve member is adapted to allow the portion of the propellant material and the at least a portion of the second material to flow through an opening in the check valve housing when a pressure within the first container assembly is higher than a pressure within the second container assembly.

25. A method of mixing first and second materials, comprising the steps of:

providing a first container assembly comprising a first container and a first valve assembly operable in open and closed configurations, where the first valve assembly comprises a first valve housing defining a first housing chamber, and a first valve member defining a valve stem portion, where the first valve member is partly arranged within the first housing chamber with the valve stem portion extending out of the first valve chamber;

providing a second container assembly comprising a second container and a second valve assembly operable in open and closed configurations, where the second valve assembly comprises a second valve housing defining a second housing chamber, and a second valve member that defines a stem seat and is arranged substantially within the second housing chamber; and arranging the second material and a propellant material within the first container such that the propellant material pressurizes the second material;

arranging the first material within the second container;

establishing a partial vacuum within the second container assembly when the first material is arranged within the second container assembly;

providing a coupler comprising first and second connecting portions, where the first connecting portion of the coupler defines a connecting chamber adapted to receive the valve stem portion of the first valve member; and the second connecting portion of the coupler defines a coupler stem portion, where the stem seat of the second valve member is adapted to received the coupler stem portion;

engaging the second connecting portion with the second valve assembly;

engaging the first connecting portion with the first valve assembly;

forming a mixture of the first and second materials by displacing the first and second container assemblies towards each other to place the first and second valve assemblies in the open configuration and cause a portion of the propellant material and at least a portion of the second material to flow into the second container such that the first and second materials are mixed in the second container.

* * * * *